United States Patent [19]

Boulard, Michel

[11] Patent Number: 4,751,357

[45] Date of Patent: Jun. 14, 1988

[54] MICROWAVE OVEN WITH MOVING EQUIPMENT, AND AN ACCESSORY FOR THE OVEN

[76] Inventor: Boulard, Michel, 11 rue de Metz, 80000 Amiens, France

[21] Appl. No.: 911,337

[22] Filed: Sep. 25, 1986

[30] Foreign Application Priority Data

Oct. 1, 1985 [FR] France ..... 85 14513

[51] Int. Cl.[4] ..... H05B 6/72

[52] U.S. Cl. ..... 219/10.55 F; 219/10.55 E; 219/10.55 R

[58] Field of Search ..... 219/10.55 E, 10.55 R, 219/10.55 F

[56] References Cited

U.S. PATENT DOCUMENTS 4,335,290 6/1982 Teich ..... 219/10.55 E
4,409,453 10/1983 Smith ..... 219/10.55 E
4,595,827 6/1986 Hirai et al. ..... 219/10.55 E

*Primary Examiner*—Robert S. Macon
*Attorney, Agent, or Firm*—Gerald J. Ferguson, Jr.; Michael P. Hoffman; Michael J. Foycik, Jr.

[57] ABSTRACT

A microwave oven includes an insulating enclosure subjected to microwave radiation, a moving sole plate, a device for vertically displacing the sole plate inside the enclosure, and a fastening device for attaching a work accessory to a wall of the enclosure opposite to the sole plate. A particular accessory usable with the oven is a mixer with two helicoidal blades mounted on either side of a vertical shaft.

9 Claims, 4 Drawing Sheets

MICROWAVE OVEN WITH MOVING EQUIPMENT, AND AN ACCESSORY FOR THE OVEN

The present invention relates to a microwave oven with moving equipment, and also to an accessory for the oven.

BACKGROUND OF THE INVENTION

Microwave ovens are presently known which are fitted with a rotary sole plate for subjecting food to the effects of the microwaves in a uniform manner, thereby obtaining uniform cooking. However, such devices cannot be used to perform work on the material being cooked, and therefore cannot be used for applications requiring such work, for example in pastry making.

An aim of the present invention is to provide a microwave oven including moving equipment adaptable to various conditions for working the material being cooked.

SUMMARY OF THE INVENTION

This aim is achieved, in accordance with the invention, by providing a microwave oven comprising an insulating enclosure which is subjected to microwave radiation, a moving sole plate, means for vertically displacing the sole plate within the enclosure, and fastening means for attaching a work accessory on a wall of the enclosure opposite to the sole plate.

Thus, after attaching the accessory on the fastening means, the position of the accessory is adjusted relative to the substance to be worked which is disposed in a receptacle placed on the sole plate by controlling the vertical displacement of the sole plate.

In an advantageous version of the invention, the means for vertically displacing the sole plate comprise a support rod which is slidably mounted through an opening in the bottom wall of the enclosure together with means disposed outside the enclosure for displacing the support rod in translation. In this way, the means for displacing the support rod do not reduce the useful volume inside the enclosure.

In a preferred embodiment of the invention, the means for displacing the support rod in translation comprise a moving frame mounted to be displaced in translation on an endless screw fixed to the enclosure, said frame being driven in translation by a nut constrained to move with the frame, mounted on the endless screw and rotated by a motor carried by the frame. Thus, the position of the frame, and hence of the sole plate, is easily controlled by rotating the motor in one direction or the other.

Another aspect of the invention provides an accessory for a microwave oven as defined above, the accessory comprising a mixer having two helicoidal blades mounted on either side of a vertical shaft fixed to the oven's accessory fastening means. Thus, by providing relative rotation between the mixer and the substance to be processed, the substance is uniformly mixed during cooking.

According to a preferred embodiment of this aspect of the invention, the accessory includes two vertical scrapers each pivotally mounted to the end of a respective one of the mixer blades. Thus, any substance which tends to adhere to the inside wall of the receptacle containing the substance is returned towards the middle of the receptacle where it falls back into the mixer.

BRIEF DESCRIPTION OF THE DRAWINGS

An embodiment of the invention is described by way of example with reference to the accompanying drawings, in which.

MORE DETAILED DESCRIPTION

Figure 1:
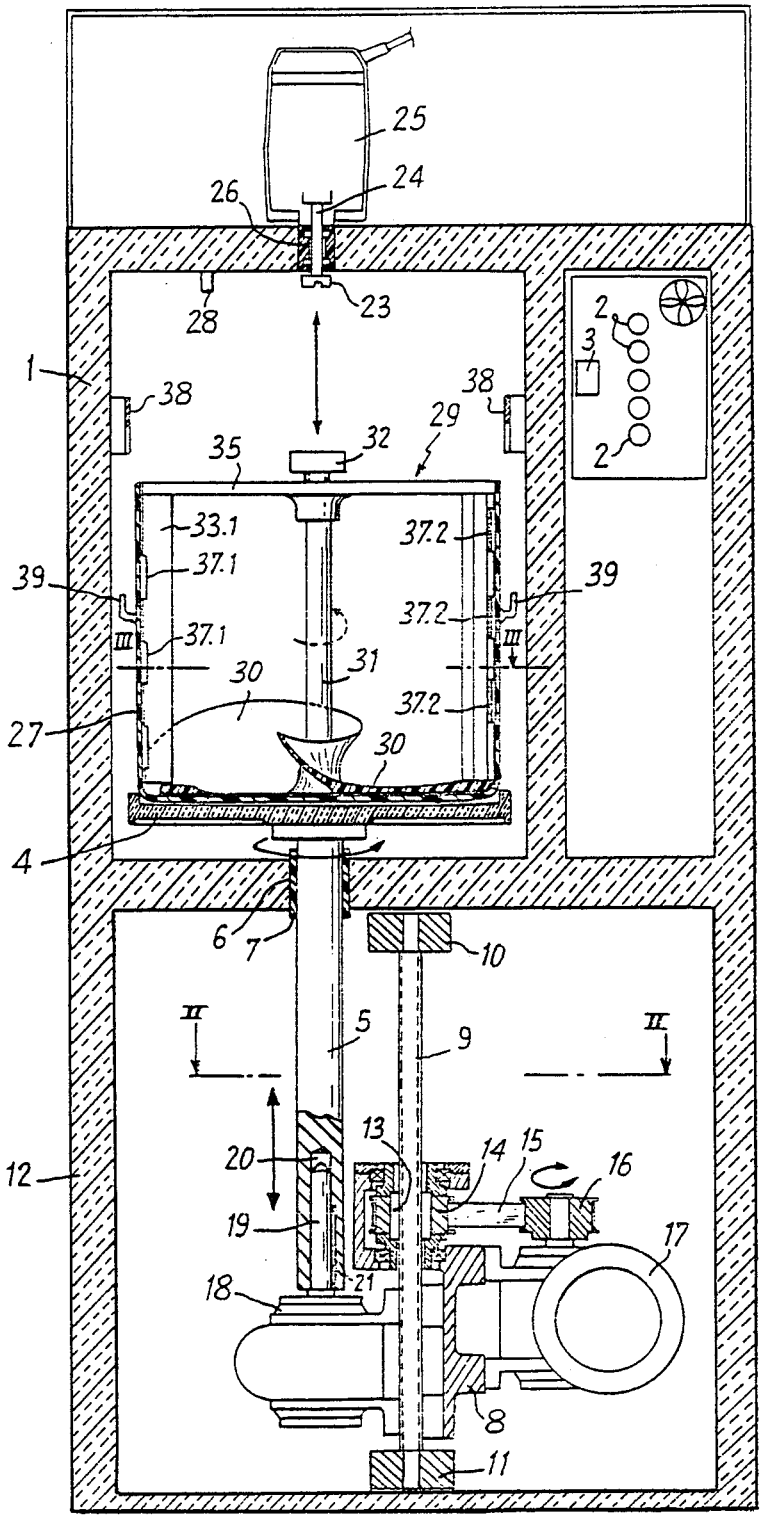
FIG. 1 is a diagrammatic vertical section through a microwave oven in accordance with the invention.

With reference to the drawings and in conventional manner, a microwave oven in accordance with the invention comprises an insulating enclosure 1 subjected to radiation from microwave generators 2 via a waveguide 3. A moving sole plate 4 is disposed inside the insulating enclosure 1.

In accordance with the invention, the oven includes means for vertically displacing the sole plate 4 inside the enclosure. In the particular embodiment shown, the means for vertically displacing the sole plate 4 comprise a support rod 5 slidably mounted through an opening 6 in the bottom wall of the enclosure 1. Where the support rod 5 passes through the opening 6, the enclosure 1 includes a seal 7 for allowing the support rod 5 to rotate and to mvoe axially, but providing sealing against microwaves.

Means are provided outside the enclosure for displacing the support rod 5 in axial translation. These means comprise a moving frame 8 mounted to mvoe in translation on an endless screw 9 which is itself fixed to the enclosure at its top end by means of a cross-bar 10 and is held in its bottom end by means of a cross-bar 11 which is fixed to a housing 12 which surrounds the means for displacing the support rod 5. The frame 8 is driven in translation by a nut 13 mounted to rotate on the endless screw 9 but constrained to move axially with the frame 8. The nut is surrounded by a pulley 14 which is driven by a belt 15, for example a notched belt, which also passes round a pulley 16 on a first drive motor and stepdown gear unit 17 carried by the frame 8.

The frame 8 also carries a second drive motor and stepdown gear unit 18 whose drive shaft 19 is engaged in an axial bore 20 in the bottom of the support rod 5. The support rod 5 is constrained to rotate with the shaft 19 by means of a key 21.

Figure 2:
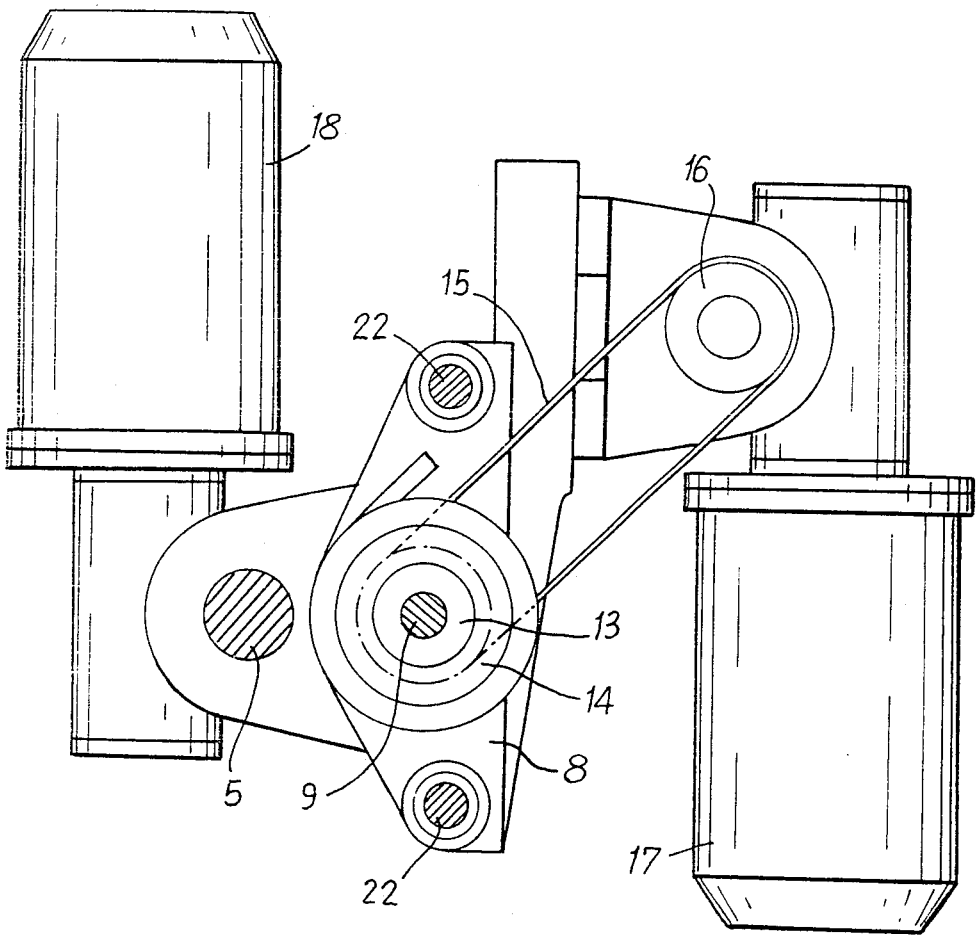
FIG. 2 is a section on a line II—II of FIG. 1.

In order to guide the frame 8 properly as it moves along the endless screw 9, smooth guide columns 22 are also fixed to the cross-bars 10 and 11 on either side of the endless screw 9 (see FIG. 2).

The enclosure 1 includes fastening means for attaching a work accessory on the enclosure wall which is opposite to the sole plate 4. In the preferred embodiment shown, the fastening means comprise the bottom end 23 of the shaft 24 of an electric motor 25. The shaft 24 is rotatably mounted in a ball bearing 26 which is microwave-proof. Thus, the bottom end 23 of the shaft 24 serves not only as means for attaching a work accessory, it also serves as means for rotating the accessory.

A microwave oven in accordance with the invention works as follows: a work accessory, for example a conventional accessory such as a mixer, whisks, or a pastty-making hook is attached to the fastening means 23 and a receptacle 27 containing a preparation to be worked is also placed inside the enclosure 1 while the sole plate is in its bottom position as shown in FIG. 1. The motor unit 17 is rotated in the appropriate direction from a control box (not shown) in order to cause the receptacle 27 to rise toward the accessory disposed inside the enclosure 1. In order to avoid accidents while the receptacle 27 is moving upwardly, an end-of-stroke contact 28 is advantageously placed in the top of the enclosure 1 in order to stop the motor unit 17 if the top edge of a receptacle comes close to the top wall of the enclosure 1.

It may be observed that in this first aspect of the invention, the accessory and the receptacle 27 may be made to rotate relative to each other either by the motor 25 rotating the shaft 24 or else by the motor unit 18 rotating the sole plate 4.

Figure 3:
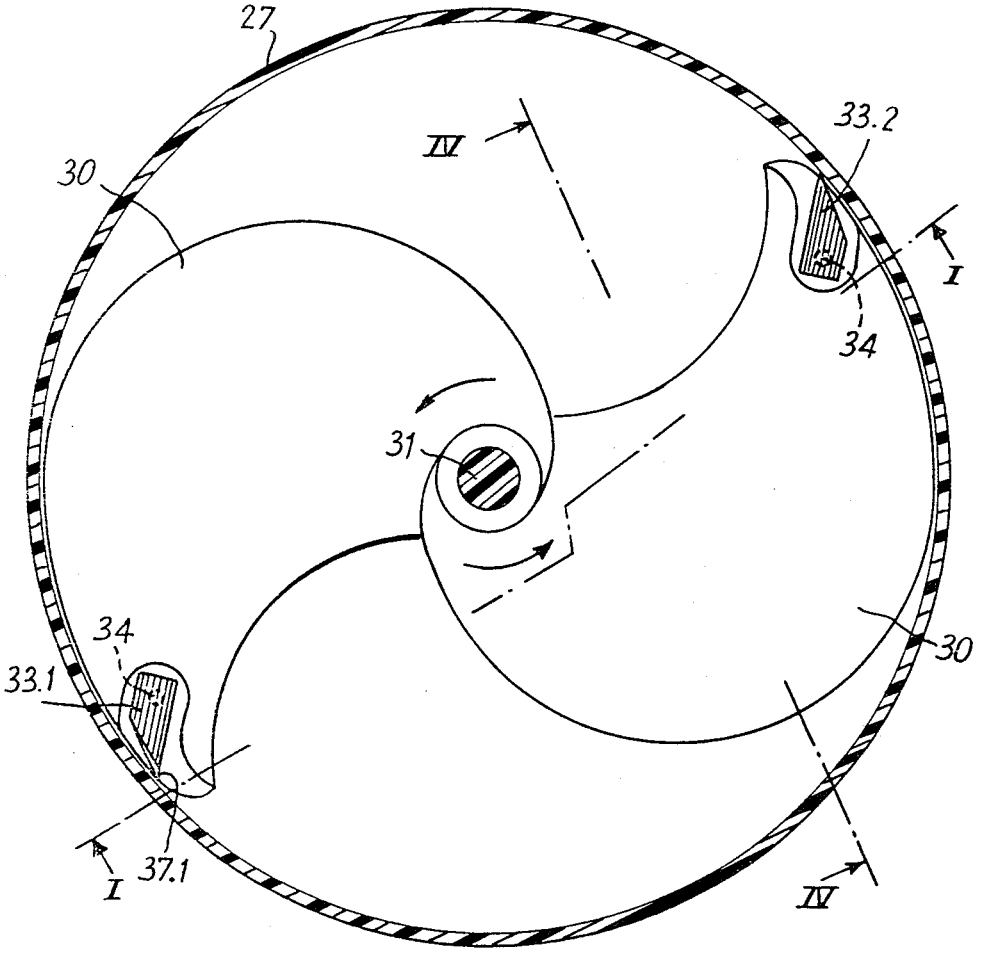
FIG. 3 is a section on a line III—III of FIG. 1.
Figure 4:
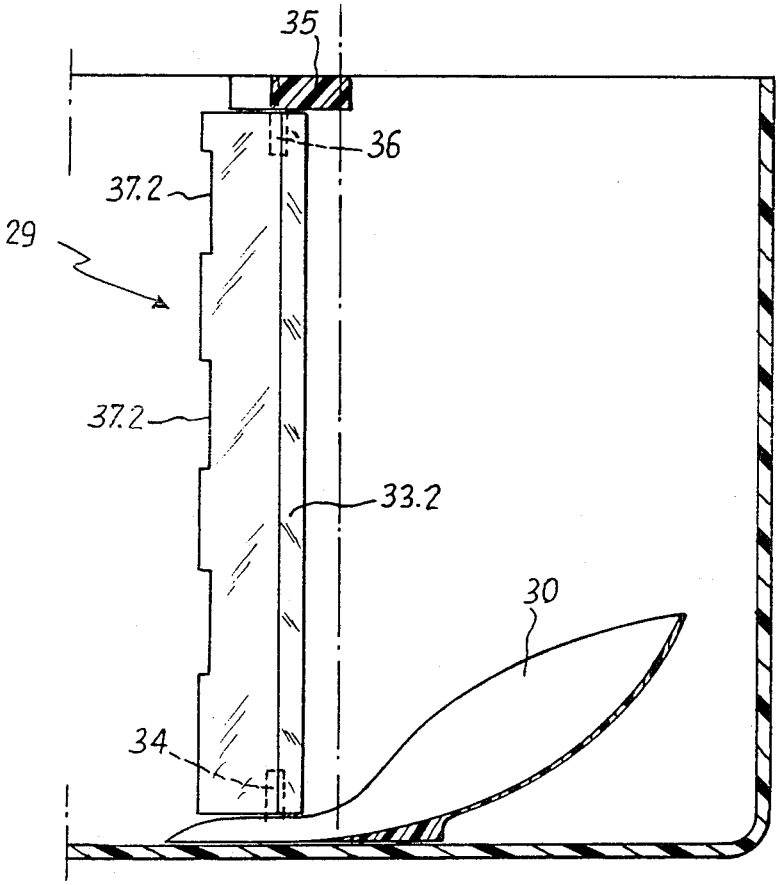
FIG. 4 is a section on a line IV—IV of FIG. 3.

In a second aspect, the invention provides a special accessory as shown in FIGS. 1, 3 and 4. In this contest, it may be observed in FIG. 1 that the means for driving the sole plate 4 are shown in section on a plane passing through the axis of the support rod 5 and through the endless screw 9, while the receptacle 27 and the special accessory which are together given a general reference 29 are shown in FIG. 1 in section on a staggered line I—I of FIG. 2.

The accessory 29 comprises a mixer with two helical blades 30 mounted on either side of a vertical shaft 31 with a fastening ring 32 for fixing to the fastening end 23 if the shaft 24. In the preferred embodiment shown, the accessory 29 also includes two vertical scrapers 23.1 and 23.2 each of which is pivotally mounted about a pivot 34 at the end of a respective one of the mixer blades 30. In order to avoid applying too high a cantelever force to the scrapers 33.1 and 33.2, it is preferable to provide a cross-bar 35 at the top end of the accessory 29 with the tops of the scrapers being pivotally mounted to the cross-bar by means of additional pivots 36. In order to keep the scrapers properly pressed against the inside wall of the receptacle 27 without excessively increasing the friction thereagainst, the leading edges of the scrapers are notched with respective notches 37.1 and 37.2. It can be seen in FIG. 1 that the notches 37.1 of the scraper 33.1 are located at different levels than the notches 37.2 of the scraper 33.2, thereby providing an alternating effect between the scrapers and thus enabling the entire area of the receptacle side wall to be scraped during a full turn of the accessory 29. In the embodiment shown, the accessory 29 is preferably rotated by the rotor 25 driving the shaft 24. In order to avoid the receptacle 27 being rotated as well, in particular when the preparation inside the receptacle is stiff and gives rise to a friction force between the accessory 29 in the inside surface of receptacle 27 which is larger than the friction force between the bottom of receptacle 27 and the sole plate 4, locking tab 38 are fixed to the inside walls of the enclosure 1 and cooperate with hooks 39 fixed to the outside wall of the receptacle 27 once the sole plate 4 has been lifted high enough.

With reference to the accessory 29, it may be observed that it extends over a greater height than the available space between the top edge of the receptacle 27 and the accessory fastening means 23, even when the sole plate 4 is in its bottom position. The receptacle 27 cannot therefore be inserted into the oven after the accessory 29 has been attached therein. It is therefore necessary to insert the accessory 29 into the receptacle 27 and then to insert the receptacle with the accessory inside it into the enclosure 1. Thereafter the accessory 29 is raised and attached to the fastening means 23. The reverse procedure is used after cooking.

Naturally, the invention is not limited to the embodiment described but extends to numerous variants which will occur to the person skilled in the art.

In particular, the motor and stepdown gear unit 17 together with the associated drive means may be replaced by a pneumatic actuator whose control rod is disposed parallel to the support rod 5.

Other conventional equipment (not shown) may also be provided, for example a temperature-sensitive cell and/or probe which is preferably fixed to the top of the oven and is associated with a programmer for controlling different cooking operations. In this case, it is preferable for the programmer to be used also for controlling movement of the sole plate by acting on the power supply to the motor units 17 and 18.

It may also be observed that the hooks 39 include a horizontal branch which may advantageously be used for inserting the receptacle 27 by means of a lifting device including telescopic arms capable of entering the oven horizontally. To this end, T-shaped hooks may be provided including a branch extending upwardly as shown, and a second branch extending downwardly for engaging the lifting device.

Other equipment associated with the oven may also be provided, for example a refrigerator set to operate in alternation with the microwave generator in order to perform pasturization, or a pumping device associated with tubes for inserting or removing fluid, thereby enabling the oven to operate continuously or semi-continuously.

What is claimed is:

1. A microwave oven comprising an insulating enclosure subjected to microwave radiation, a moving sole plate, means for vertically displacing the sole plate inside the enclosure, fastening means for attaching a mixing member to a wall of the enclosure opposite to the sole plate and means for imparting a relative horizontal movement between the mixing member and the sole plate whereby a product supported by the sole plate is stirred while being subjected to microwave radiation.

2. A microwave oven according to claim 1, wherein the means for vertically displacing the sole plate comprise a support rod slidably mounted through an opening in the bottom wall of the enclosure, and means disposed outside the enclosure for displacing the support rod in translation.

3. A microwave oven comprising an insulating enclosure subjected to microwave radiation, a moving sole plate, means for vertically displacing the sole plate inside the enclosure, and fastening means for attaching a work accessory to a wall of the enclosure opposite to the sole plate; wherein the means for displacing the support rod in translation comprises a moving frame mounted to move in translation along an endless screw fixed to the enclosure, said frame being driven in translation by means of a nut mounted on the endless screw and constrained to move with the frame, said nut being rotated by a motor mounted on the frame.

4. A microwave oven according to claim 1, including means for rotating the means for attaching the work accessory.

5. A microwave oven according to claim 4, including locking tab fixed to the side walls of the enclosure.

6. A microwave oven according to claim 2, including means for rotating the support rod.

7. A microwave oven comprising an insulating enclosure subjected to microwave radiation, a moving sole plate, means for vertically displacing the sole plate inside the enclosure, and fastening means for attaching a work accessory to a wall of the enclosure opposite to the sole plate; means for rotating the means for attaching the work accessory;

said accessory comprising a mixer including two helicoidal blades mounted on either side of the vertical shaft.

8. A microwave oven according to claim 7, including two vertical scrapers each pivotally-mounted at the end of a respective one of the mixer blades.

9. A microwave oven according to claim 8, wherein the scrapers include notches in their leading edges, with the positions of said notches alternating from one scraper to the other.

* * * * *